US008117957B2

(12) United States Patent
Loganchuk

(10) Patent No.: US 8,117,957 B2
(45) Date of Patent: Feb. 21, 2012

(54) BREECH DEVICE FOR A HAND FIREARM

(76) Inventor: Vladimir Loganchuk, Vancouver (CA)

( * ) Notice: Subject to any disclaimer, the term of this patent is extended or adjusted under 35 U.S.C. 154(b) by 392 days.

(21) Appl. No.: 12/508,651

(22) Filed: Jul. 24, 2009

(65) Prior Publication Data

US 2011/0017057 A1 Jan. 27, 2011

(51) Int. Cl.
*F41A 3/56* (2006.01)

(52) U.S. Cl. ..... 89/180; 42/1.06; 42/14; 42/69.01

(58) Field of Classification Search ..... 42/1.06, 42/14, 15, 16, 69.01, 69.02, 69.03; 89/130, 89/132, 152, 153, 180, 181, 190, 187.01
See application file for complete search history.

(56) References Cited

U.S. PATENT DOCUMENTS

| | | | | | |
|---|---|---|---|---|---|
| 1,178,468 | A | * | 4/1916 | Hartigan et al. | 89/138 |
| 1,365,355 | A | * | 1/1921 | Thompson | 89/188 |
| 1,907,164 | A | * | 5/1933 | White | 89/138 |
| 2,270,683 | A | | 1/1942 | Janecek | |
| 2,348,790 | A | * | 5/1944 | Kucher et al. | 89/152 |
| 2,571,132 | A | * | 10/1951 | Harvey | 42/69.03 |
| 2,774,283 | A | * | 12/1956 | Harvey | 89/194 |
| 3,618,455 | A | * | 11/1971 | Plumer et al. | 89/132 |
| 7,000,345 | B1 | * | 2/2006 | Kay | 42/75.02 |
| 7,219,461 | B1 | * | 5/2007 | Keeney et al. | 42/16 |
| 7,261,029 | B1 | * | 8/2007 | Davis | 89/148 |
| 7,568,422 | B1 | * | 8/2009 | Barrett | 89/180 |

FOREIGN PATENT DOCUMENTS

| | | |
|---|---|---|
| CZ | 58598 | 1/1937 |
| CZ | 59377 | 6/1937 |
| CZ | 2006-341 | 12/2007 |
| WO | WO 9827396 A1 * | 6/1998 |
| WO | 2007137524 A2 | 12/2007 |

OTHER PUBLICATIONS

WO 2007/137524 A3, International Search Report Search of PCT/CZ 2007/000034, dated Jan. 31, 2008, 4 pages.

* cited by examiner

*Primary Examiner* — Benjamin P Lee
(74) *Attorney, Agent, or Firm* — Wood, Herron & Evans, LLP

(57) ABSTRACT

A breech device of a hand firearm comprises a firearm casing, a trigger mechanism, a carrier slidably arranged within the firearm casing, and a breech block engaging the carrier and having a firing pin. The breech device further includes a tensioning element slidably engaged with the carrier and coupled to at least one follower pin engaging the firing pin and slidably engaged with the breech block. The tensioning element includes a projecting part having a forward-directed nose adapted to engage a stop detent on the trigger mechanism. The breech device further includes a tensioning pin slidably engaged with the carrier and the breech block.

12 Claims, 11 Drawing Sheets

BREECH DEVICE FOR A HAND FIREARM

BACKGROUND

The invention relates to a breech device of a hand firearm, comprising a firearm casing with a slidingly arranged carrier with a breech block, which comprises a slidingly arranged firing pin with a striker, wherein a locking arm is pivoted in the rear portion of the carrier.

A locking mechanism is known from the patent documents CZ 58598 and CZ 59377 (Frantisek Janecek et al.), wherein the locking mechanism functions from the so called back position, which means that whole of the breech device is in the back position before the shot. In such a mechanism the striker is fixed to the carrier of the breech block and a shot is fired only after a complete locking. Such a construction of the whole locking mechanism is not preferred because the breech device has to be unlocked and the return springs have to be fully tensioned if the fire arm is to be prepared for shooting. Because of the impact of the relatively huge mass of the breech device the aiming of the firearm is disturbed, especially in the semi automatic firing mode. Another locking mechanism is known from U.S. Pat. No. 2,270,683 (Frantisek Janecek) which is to work from the front position. The '683 patent discloses a locking device consisting of a breech block and a carrier which are arranged slidingly with respect to each other and which are connected by a single-arm lever, the lever being pivoted in the carrier and its free end being supported by the tail part of the breech block. At the same time, the free end of the single-arm lever is formed to engage a stop formed at the breech block casing. There is a through opening formed in the lever for an introduction of the hammer which actuates the cartridge by hitting the firing pin with the striker.

Practical experience with such a mechanism has shown that its use in current hand firearms is limited. The mechanism cannot be effectively used for fully automatic firing mode, if the firing is to be performed with the breech block having been locked and a trigger and hammer device is to be used to fire off the cartridge. The interaction of the components of the breech block and the interaction of the components and of the breech block casing is disadvantageous. During the locking of the cartridge chamber the breech block recoils backwards significantly, more specifically in that moment when the breech mechanism reaches the front position, i.e. the locking position, and when the gear ratio of the single-arm lever (the so called accelerator) is fully used to increase the locking force for a proper and safe locking of the cartridge chamber. After the impact, the carrier of the breech block recoils, wherein the single-arm lever is pivoted in the breech block and is subjected to bending within the elastic deformation region during the final phase of locking the cartridge chamber. Also the side walls of the breech block casing between the cartridge chamber and the stop are subjected to tension within the elastic deformation region. During the locking, the breech block, too, is subjected to buckling within the elastic deformation region. Any springing of the material of the breech device and of the casing material is amplified by the gear ratio of the single-arm lever. The extent of the recoil depends especially on the gear ratio of the single-arm lever, on the tension of the return spring, on the elastic modulus of the materials, of which the respective components of the breech device and the casing are made, on the weight of the carrier of the breech block, on the frictional resistance of the sliding components of the breech device, and on the angle of inclination of the firearm, i.e. elevation or depression.

Any substantial recoil of the breech device is unacceptable because the firing of the cartridge is executed too early, specifically at the time when the cartridge chamber has not been fully locked yet. Such firing causes a loss of the fully automatic function of the firearm. It may also cause a destruction of the bottom of the cartridge because the pressure of the gases at the time of recoil pushes the cartridge out of the cartridge chamber such that a part of the cartridge wall gets outside the cartridge chamber into a free unprotected space where the unprotected part of the wall of the cartridge will not resist the pressure of the gases inside the cartridge. So the unprotected wall of the cartridge is destroyed and the leaking gas expands and the mechanism of the hand firearm as well as the health of the shooter may be affected.

The disadvantages and deficiencies of the firearm as disclosed in U.S. Pat. No. 2,270,683 are eliminated at least partially by the locking mechanism of a hand firearm disclosed in the Czech patent application No. CZ PV 341-2006 (Ladislav Findorak). The unwanted recoil of the carrier of the breech block, which may cause a faulty locking of the cartridge chamber, is prevented by an increased clearance between the cross stop of the firearm casing and the locking lever. For such a construction, the longitudinal shaping of the locking lever in the breech block carrier is essential. As described in the Czech patent application, the primer of the cartridge is actuated by the striker, which transmits the power from the hammer. Although the recoil of the breech block carrier is lower compared with the previously described mechanism, the recoil is still objectionable, especially if the firearm is to function properly in the fully automatic mode. Tests have shown that if the clearance between the locking arm and the cross stop in the firearm casing is larger than an assembly clearance, which is about 0.2 millimetres depending on the gauge of the firearm, so-called tapping at the cross stop occurs during the shooting. The tapping increases the running clearance and lowers the locking power, which results in higher and higher velocities of the breech masses over the working life of the breech device. When the above described clearances are larger than the allowable assembly clearances, the locking lever is in an unidentified position before the shooting due to the shaping of the seat of the lever and the lever's heavier weight and inertia. As shown in CZ PV 341-2006, where the clearances are larger than the assembly clearances, upper nose 49 of the single arm release lever 50 of the hammer pushes the single arm transmission lever 37, i.e. the locking lever, up because of the operation of the spring 52.

Before the firing, the single arm transmission lever 37 is seated in an unknown position due to the clearances and allowed shaping, and it has to be seated in the working position within a split second under extreme forces. Undesirable seating of the lever is also caused by the weight increase caused by the added nose for the hammer. The single arm release lever 50 with its spring acts in the direction opposite to its movement during the locking. The larger the added clearance between the lever and the cross stop of the firearm casing, the larger the overall clearances. During the firing, the locking lever has to get in its working position so that the tapping occurs within a split second and under extreme forces. An unwanted wear of the locking arm seat occurs in the device according to CZ PV 341-2006, and there is a risk of breaking the lever due to the excessive load applied for a very short time. According to practical experience, the recoil in the mechanism is markedly lowered, but it is not fully eliminated, because there is always a reaction when two elements strike against each other at high speed and with a heavy force. The device comprises a securing element to secure the locking of the breech device, and the securing element may recoil in a larger degree in the fully automatic mode of firing and therefore may affect the reliability unfavourably. This occurs because it is practically impossible to time the stroke of the hammer upon the firing pin in the first phase of locking the breech device before the recoil.

Another disadvantage of the device is the seating of the locking device in the carrier of the breech block. Moving backwards, the carrier takes the breech block by being connected by the locking arm, so that the breech block is subject to a buckling load. At the time of striking, the back of the breach block is subject to a pressure load, such that an extraordinary technology of hardening and machining is required, otherwise the breech block may break.

SUMMARY

One object of the invention is to overcome the deficiencies and disadvantages of prior art devices and to design such a breech device for a hand firearm, which provides for a safely locked cartridge chamber during the firing in both the semi automatic mode and the fully automatic mode.

This objective is achieved and the disadvantages overcome by a breech device of a hand firearm, comprising a firearm casing with a slidably arranged carrier with a breech block, which comprises a slidable firing pin with a striker. A locking arm pivoted in the rear portion of the carrier, is arranged in a vertical well in the rear portion of the carrier, and is pivoted by means of a bearing pin to enable an engagement of its free end with a cross stop of the firearm casing. The carrier is provided with a tensioning pin having an end part extending into a transfer slot formed in the breech block, inside which the slidable firing pin is provided with at least one follower pin. The follower pin is slidable in a through slot formed in a side wall of the breech block and is provided with a tensioning element. The tensioning element is slidable with its oval driving part engaging the limiting slot formed in a side wall of the carrier. The tensioning element has on the front lower portion of its projecting part a forward-directed nose for an engagement with the stop detent provided on the trigger lever of the trigger mechanism.

Advantageously, the forward-directed nose of the tensioning element is formed having a negative angle of mating with the stop detent of the trigger lever.

It is also advantageous to provide the trigger mechanism of the breech device with a trigger link, wherein one end of the trigger link is pivotally connected with the trigger and the opposite end is formed by a window portion with a window. The window is provided with forward-directed stop areas for an engagement with the bend and with a notch between them for an introduction of a bend formed on a shorter arm of the trigger lever. This forms another part of the trigger mechanism and which is pivoted in the firearm casing.

It is also advantageous to provide the carrier from below with a longitudinal recess in the side wall, the recess being intended for an introduction of a part of the window portion of the trigger link and abutting on an inclined area in the direction towards the front part of the carrier.

Advantageously, a firing mode selector is assigned to the trigger link at its central part and provided with a cross slot for at least a partial introduction of the trigger link.

Another advantage of the breech device according to the invention is its simple structure, i.e. the simple structure of the carrier, the breech block, and the locking arm. The current safety requirements in respect of firing and firearm manipulation are achieved with the improved functional safety.

The invention will become more apparent from the following detailed description thereof and from the accompanying drawings which are merely illustrative and which are not meant to limit the scope of claimed protection.

BRIEF DESCRIPTION OF THE DRAWINGS

A preferred embodiment of the invention is shown in the drawings, wherein.

DETAILED DESCRIPTION

Figure 1:
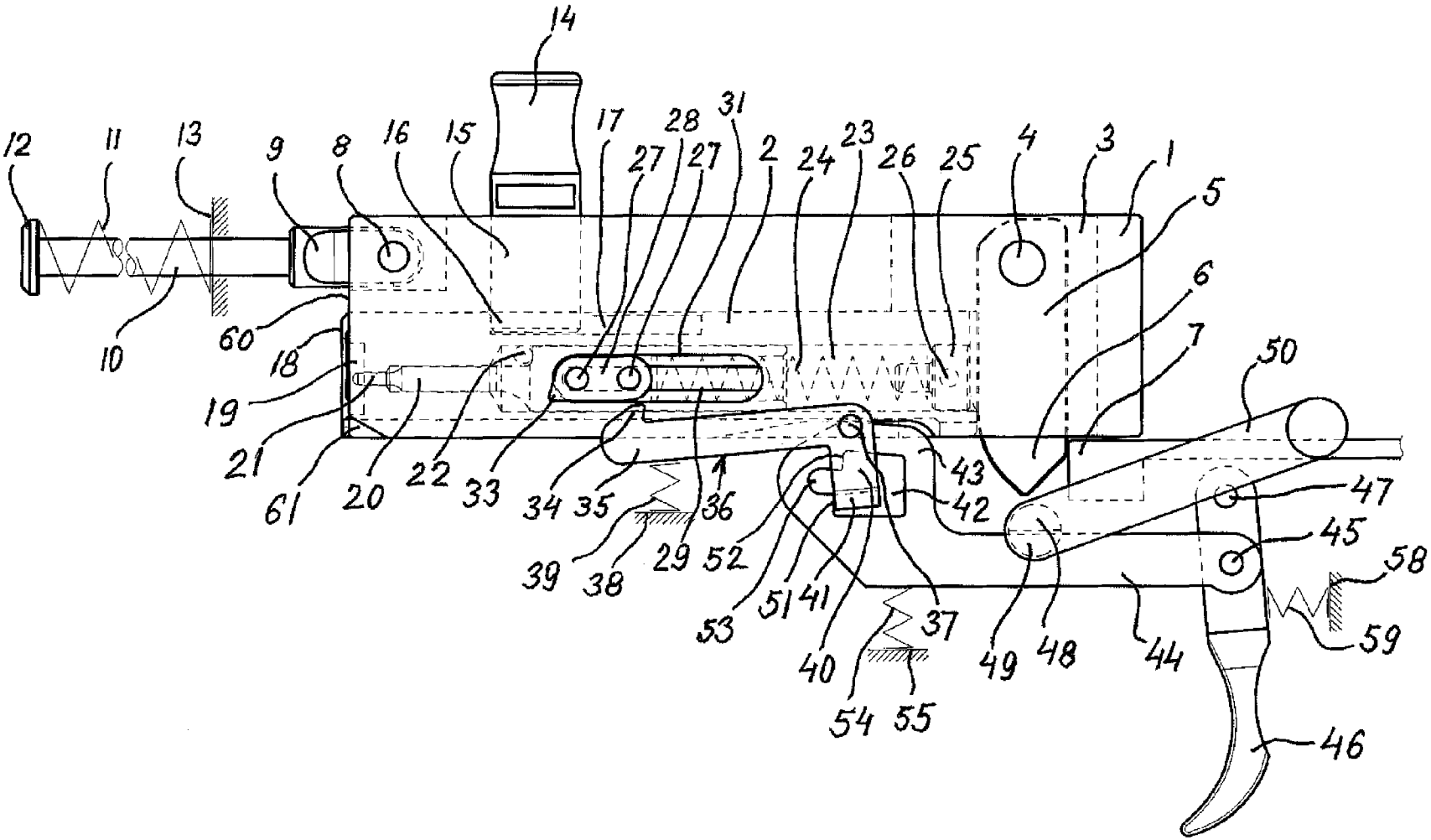
FIG. 1 shows a diagrammatic side view of the locked breech device in a standstill or as the trigger device is positioned after one shot has been fired.

The breech device according to the invention consists of a carrier 1 which is slidingly arranged in a casing (not shown) and of a breech block 2 which is slidingly arranged in the carrier 1. The carrier 1 has its rear part at least partially open in the vertical direction, advantageously in the form of a well 3 inside which a locking arm 5 is pivoted on a bearing pin 4 and the free end 6 of the locking arm 5 is designed to engage a cross stop 7, the cross stop 7 being an immovable part of the firearm casing. At the front part of the carrier 1, a guide bar 10 is hinged with its end part 9 on a fixed pin 8 and a forwarding spring 11 is drawn on the guide bar 10, one end of the forwarding spring 11 being supported by a collar 12 fixed at an end of the guide bar 10 and the other end being supported by a supporting area 13 at a firearm casing (not shown). A tensioning pin 15 is provided with a grip 14 and anchored vertically in the carrier 1, an end part 16 of the tensioning pin 15 extending into a transfer slot 17, which is formed in the upper area of the breech block 2.

The front area 18 of the breech block 2 is provided with a seat 19 for a bottom of a cartridge (not shown). A firing pin 20 is suspended slidingly within the breech block 2 and coaxially with the seat 19, the firing pin 20 being provided with a striker 21 and its forward movement in the breech block being prevented by a cross pin 22 which serves as a mounting tool. The firing pin 20 is provided with a cylindrical hollow 23 which is open at its rear end and a firing spring 24 is arranged inside the cylindrical hollow 23 and a rear end of the firing spring 24 is supported by a cover 25 inserted in an end part of the cylindrical hollow 23 and secured by a securing pin 26. A known form of a remover and ejector (not shown) for used cartridges (not shown) extends into the seat 19 of the breech block 2. At least one follower pin 27 is anchored cross-wise within the firing pin 20. One embodiment shown in the drawings comprises a pair of follower pins 27 and a tensioning element 28 for the breech block 2 is fixed on the follower pins 27. The follower pins 27 are arranged slidingly in a through slot 29 in a side wall of the breech block 2. The tensioning element 28 has an oval driving part 30 mounted slidingly in a limiting slot 31 which is formed in a side wall of the carrier 1. The tensioning element 28 is provided also with an oval projecting part 32 which has at its front lower part a forward-directed nose 33 for an engagement with a stop detent 34.

The stop detent 34 is arranged at an end of a longer arm 35 of a trigger lever 36, the trigger lever 36 being pivoted on a supporting pin 37 which is located in a side wall of the firearm casing. The nose 33 of the tensioning element 28 has a negative mating angle for the engagement with the stop detent 34. A pressure spring 39 is inserted inside the firearm casing between the longer arm 35 of the trigger lever 36 and a supporting area 38. The shorter arm 40 of the trigger lever 36 is provided with a bend 41 which extends into a window 42 formed in a window portion 43 at one end of a trigger link 44, the opposite end of the trigger link 44 being pivoted on a connecting pin 45 anchored in the central part of the trigger 46, the trigger 46 being attached to the firearm casing by means of a trigger pin 47. A fire mode selector 48 is pivoted in the central part of the trigger link 44 in the firearm casing and provided with a cross slot 49, wherein the trigger link 44 extends at least partially into the cross slot 49. Outside the firearm casing, the fire mode selector 48 is provided, e.g., with a control arm 50.

The window 42 in the window portion 43 of the trigger link 44 is provided with two stop areas 51, 52 to contact the bend 41 of the shorter arm 40 of the trigger lever 36. The lower stop area 51 is to engage the bend 41, when the trigger link 44 is seated on the bottom of the cross slot 49 on the fire mode selector 48 being in the single shot mode position. Upper stop area 52 is intended to engage the bend 41 when the trigger link 44 is seated on an edge of a sloping bottom of the cross slot 49 on the fire mode selector 48 being in the rapid fire mode position. Between the two stop areas 51, 52 a notch 53 is arranged for an introduction of the bend 41, when the trigger link 44 is seated on an edge of a partially inclined bottom of the cross slot 49 on the fire mode selector 48 being in the locked position in which no shot may be fired. The trigger link 44 is pressured by the pressure spring 54 which acts from a supporting area 55 in the firearm casing towards the carrier 1. The lower part of the side wall of the carrier 1 is provided with a longitudinal recess 56 and an inclined area 57 is arranged next to the longitudinal recess 56 towards the front part of the carrier 1. The longitudinal recess 56 is intended for the introduction of a part of the window portion 43 of the trigger link 44. Between the trigger 46 and the supporting area 58 of the firearm casing a trigger spring 59 is arranged for returning the trigger 46 in the front position. The breech block 2 is provided with a bevel at the lower part of its front part 60 to facilitate the swinging of the trigger link 44 during the forward motion of the breech block 2.

Figure 2:
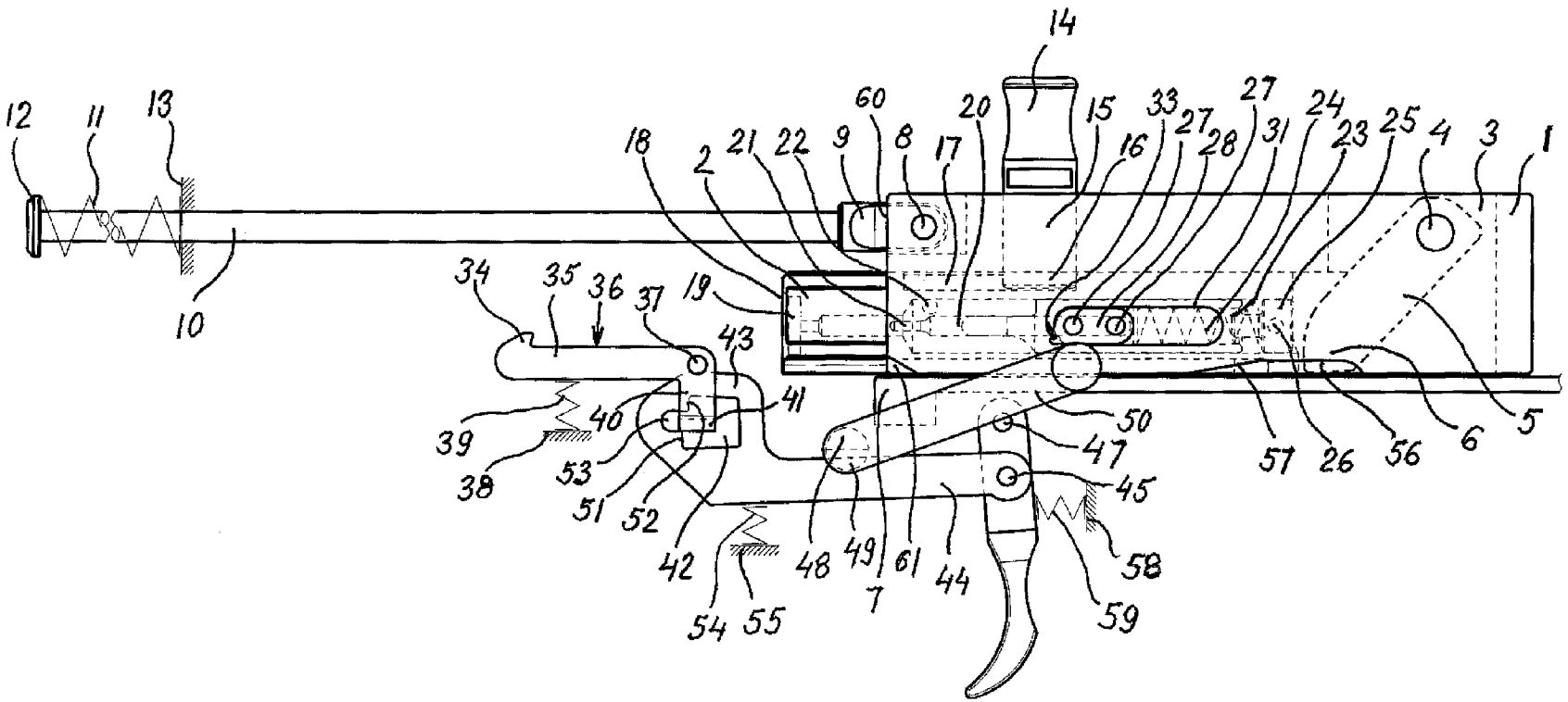
FIG. 2 shows a side view of an unlocked breech device after the back position has been reached.
Figure 3:
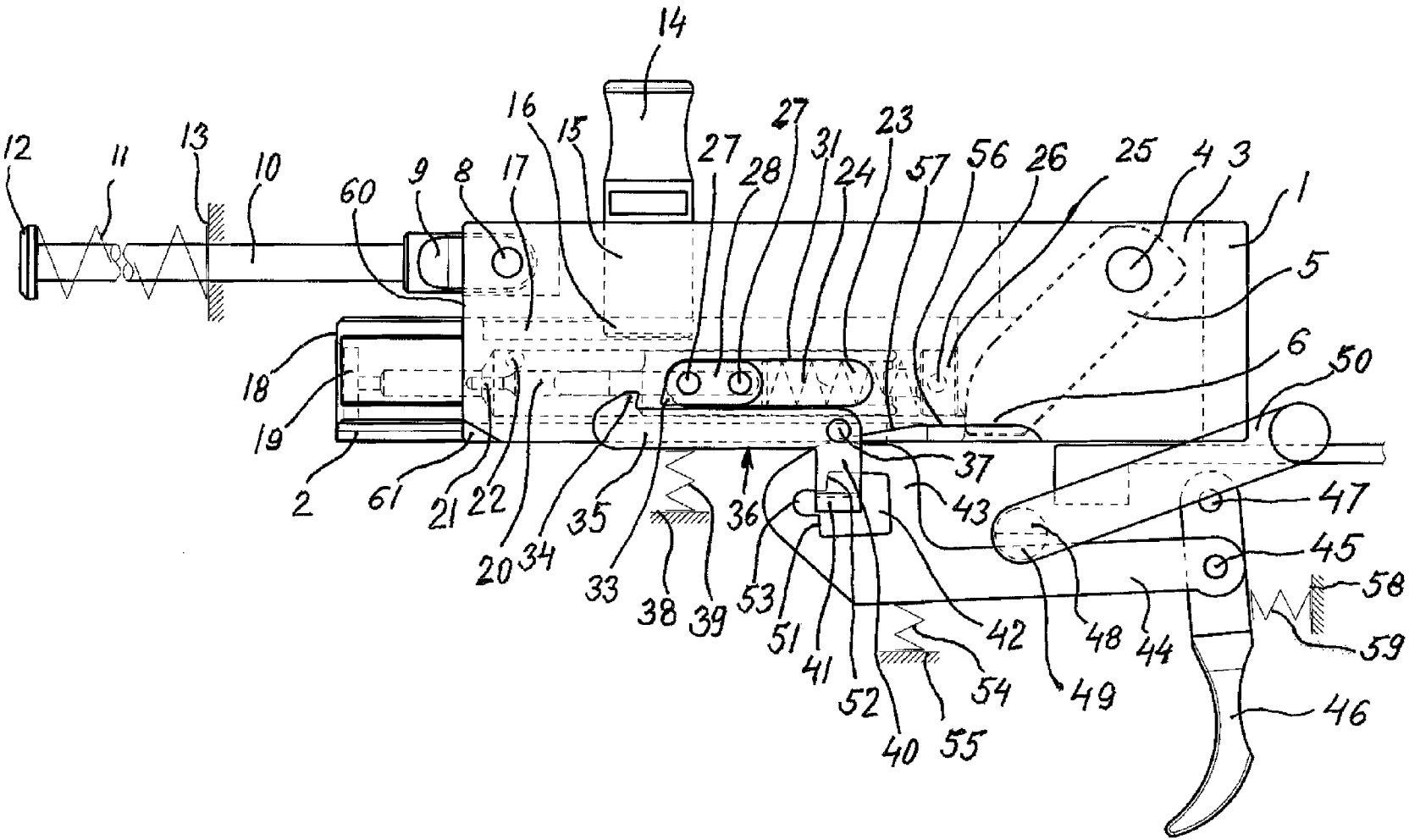
FIG. 3 shows a view of the unlocked breech device with the breech block in the front position, the cartridge (not shown) being in the cartridge chamber (not shown)
Figure 4:
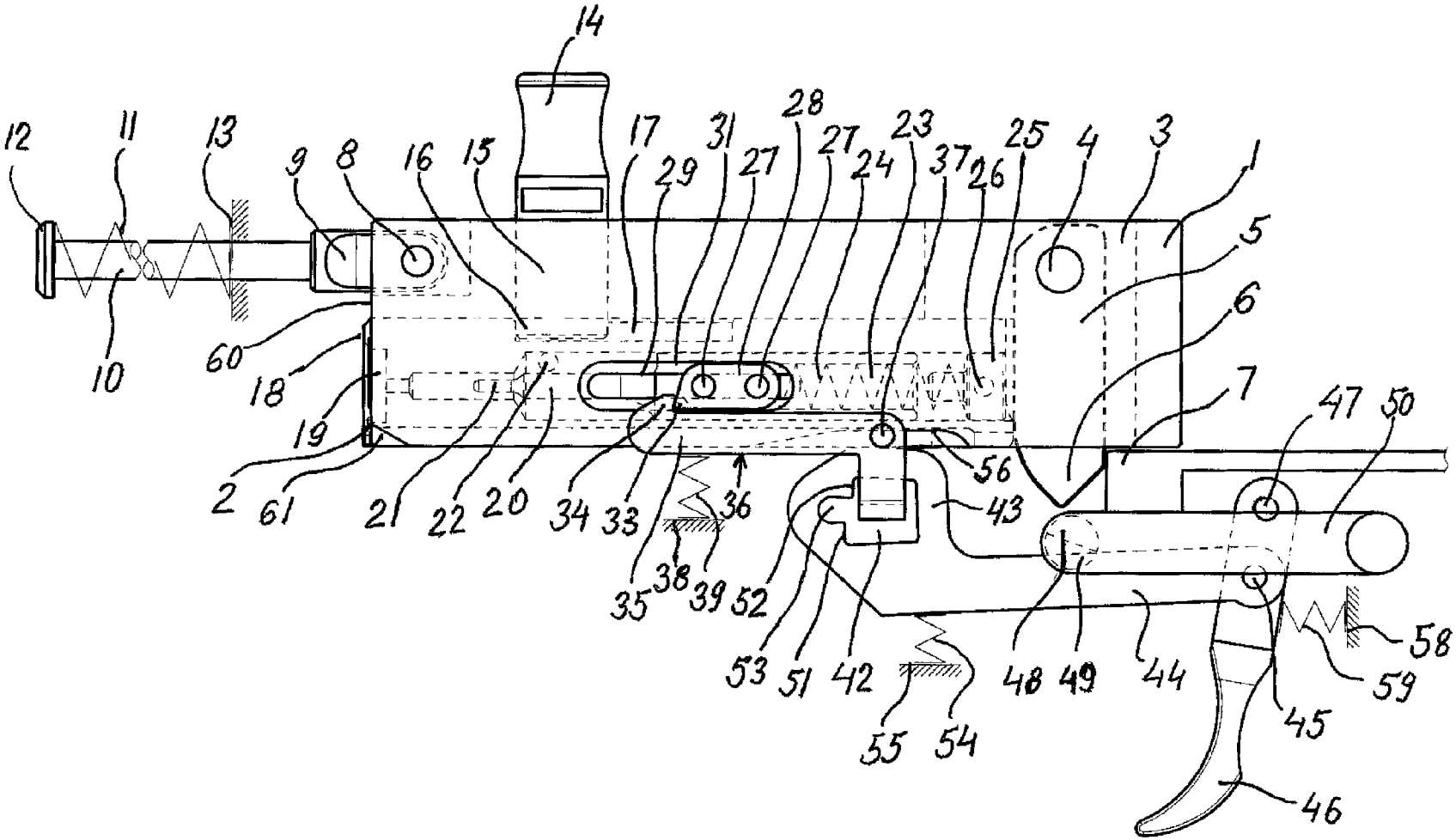
FIG. 4 is a view of the locked breech device the firing pin being tensioned and the trigger device being in the secured position.
Figure 9:
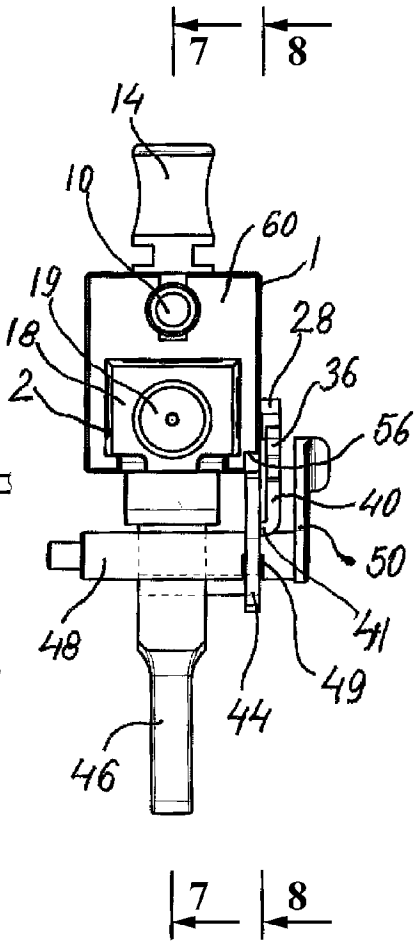
FIG. 9 is a front view of the breech device with the trigger device.

The operation of the hand firearm will now be described. Before a semi automatic or a fully automatic firing, the shooter grasps at the grip 14 of the tensioning pin 15 and by pulling it towards himself he shifts the carrier 1 against the action of the forwarding spring 11 to get the breech device in an unlocked position, wherein the locking arm 5 gets out of the engagement with the cross stop 7. During the motion the window portion 43 of the trigger link 44 gets out of the engagement with the longitudinal recess 56 in the carrier 1 and the window portion 43 being in the swivelled position and being biased by the pressure spring 54 contacts the lower surface of the carrier 1 by sliding down the inclined area 57. During the motion the breech block 2 remains in the front position, as the tensioning pin 15 is shifted in the transfer slot 17 in the upper part of the breech block 2. Because the carrier 1 and the firing pin 20 are connected by means of the tensioning element 28 and the pair of the follower pins 27, the firing pin 20 is tensioned against the action of the firing spring 24. Moving the grip 14 further backwards, the cylindrical contact surface of the end part 16 of the tensioning pin 15 engages the respective cylindrical back surface of the transfer slot 17 in the breech block 2. The shooter shifts the carrier 1 together with the breech block 2 against the action of the forwarding spring 11 in its back dead point (FIG. 2). In such a position the cartridge (not shown) is prepared to be inserted into a cartridge chamber of a barrel (not shown).

Figure 5:
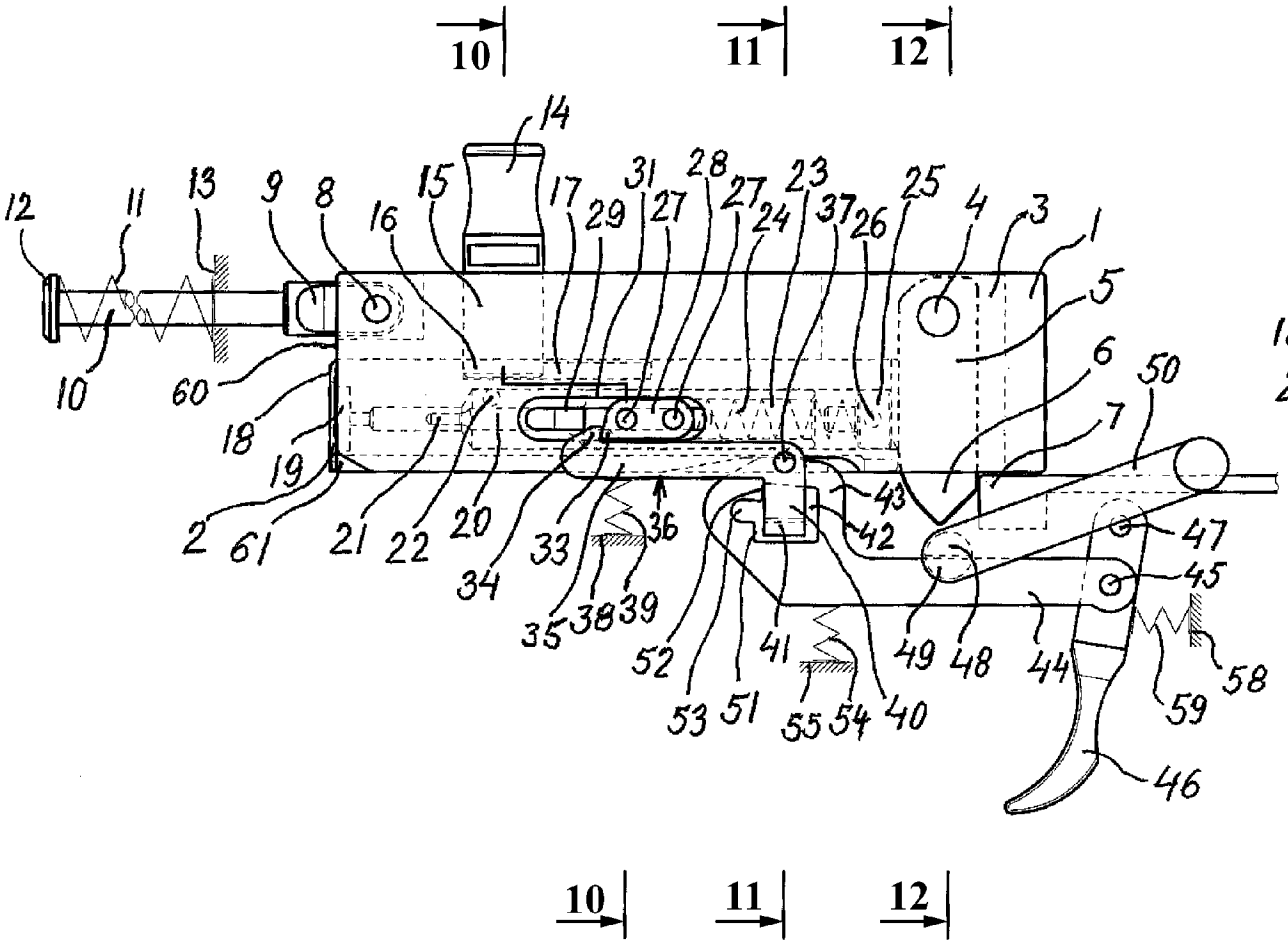
FIG. 5 is a view of the locked breech device, the trigger device being ready for firing one shot (semi automatic mode)
Figure 6:
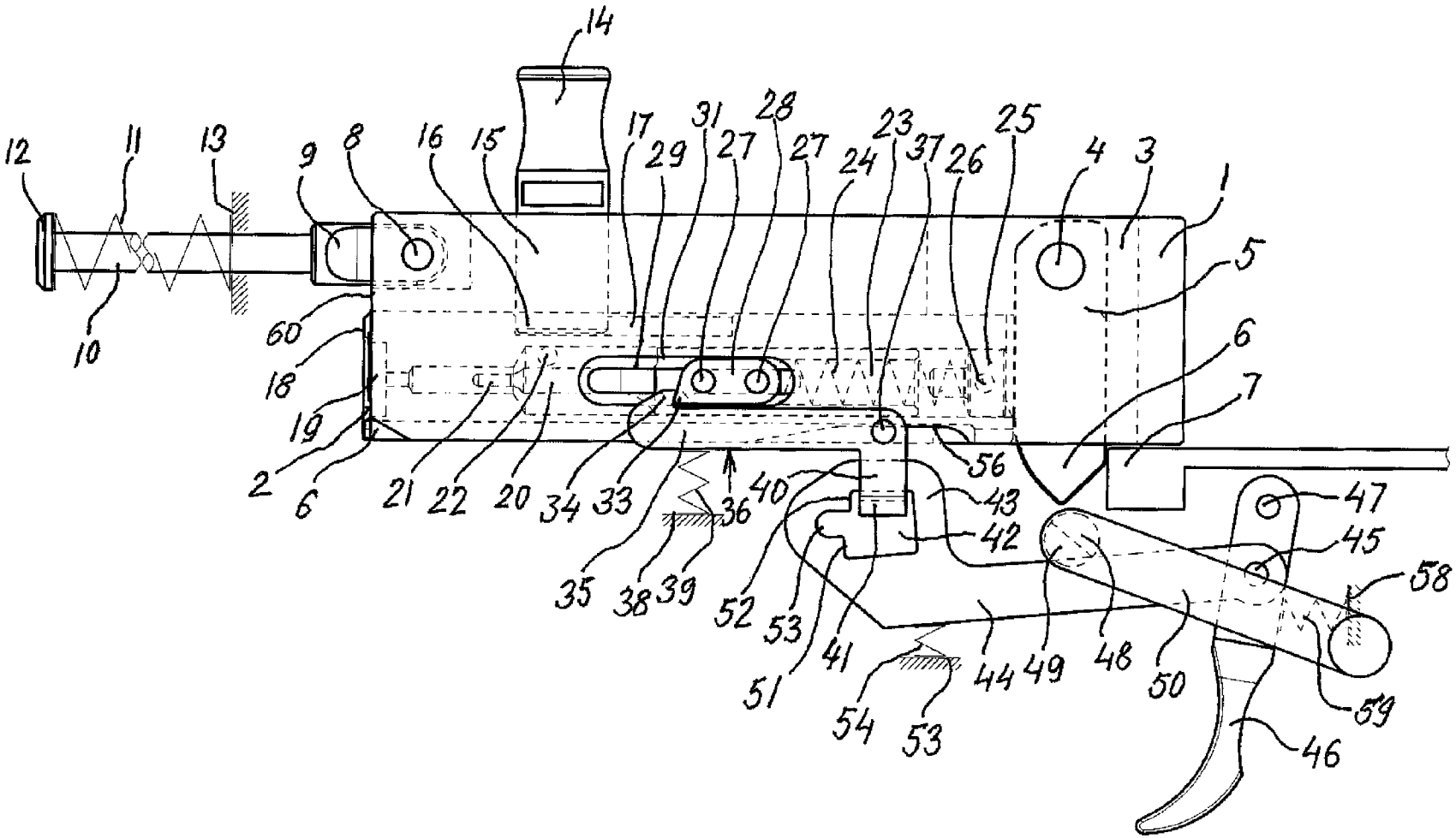
FIG. 6 is a view of the locked breech device, the trigger device being ready for firing in the fully automatic mode.
Figure 7:
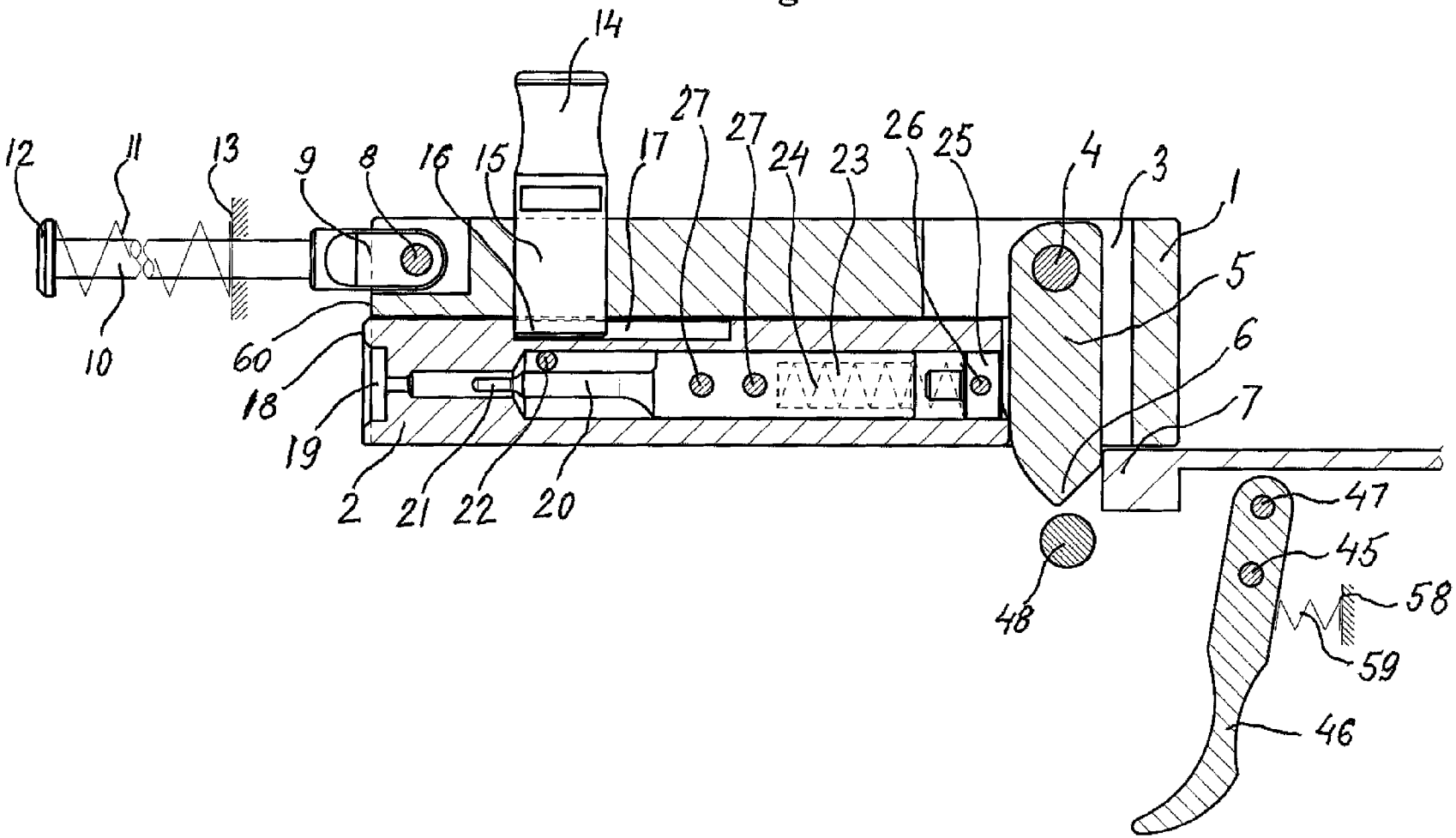
FIG. 7 is a longitudinal section view of the breech device of FIG. 9 taken along the line 7-7.
Figure 8:
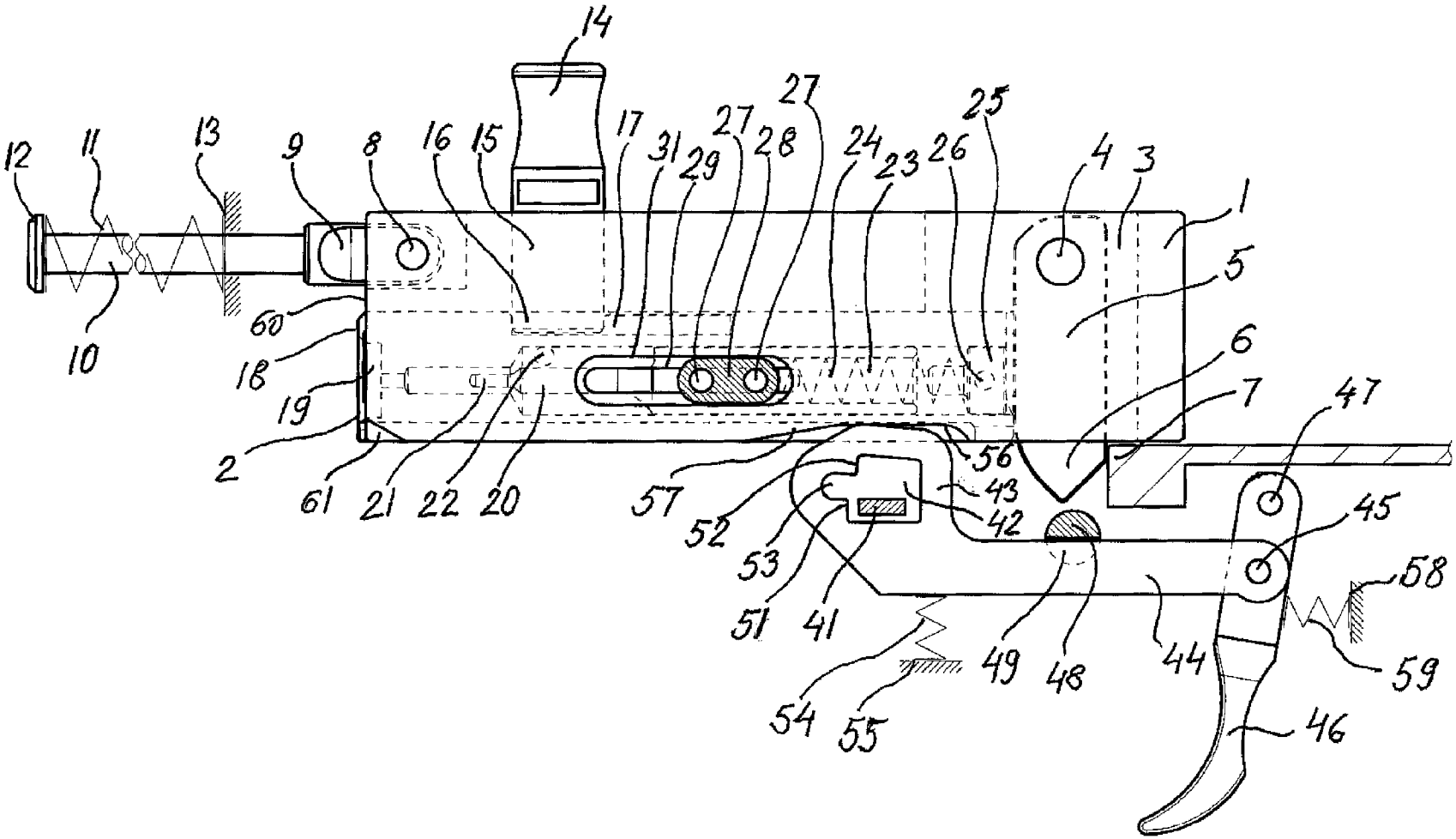
FIG. 8 is a longitudinal section view of the breech device of FIG. 9 taken along the line 8-8.
Figure 12:
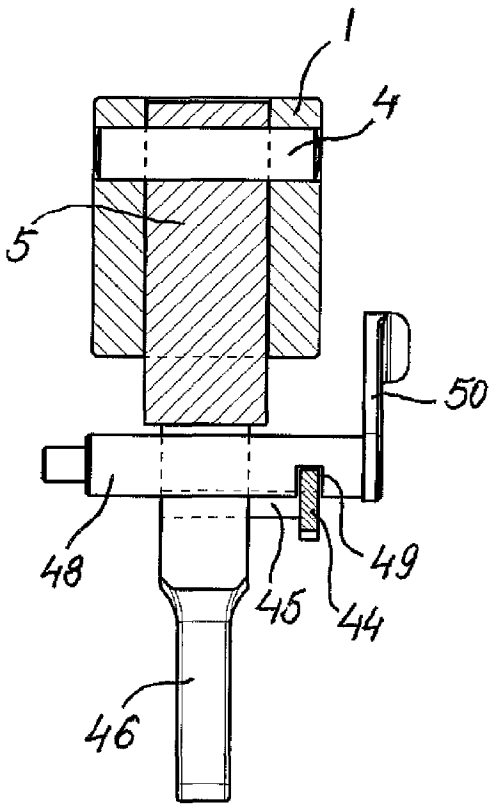
FIG. 12 is a cross section view of the breech block of FIG. 5 taken along the line 12-12.
Figure 11:
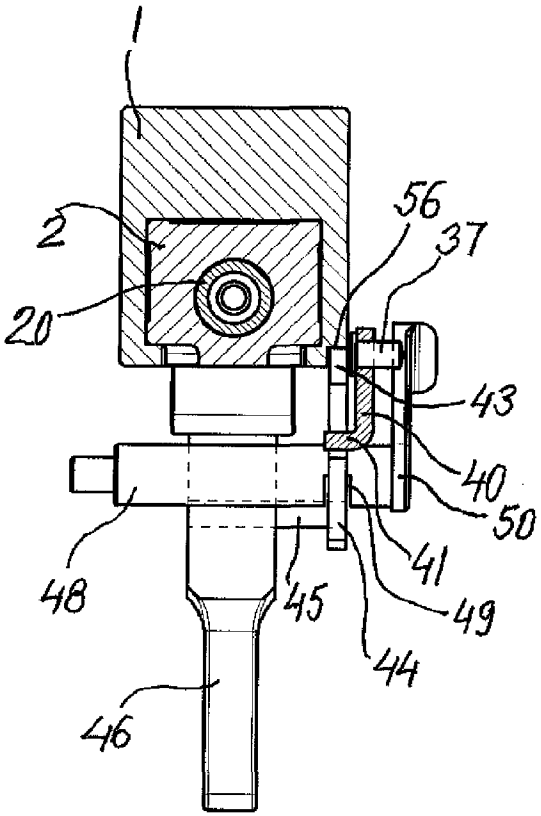
FIG. 11 is a cross section view of the breech block of FIG. 5 taken along the line 11-11.
Figure 10:
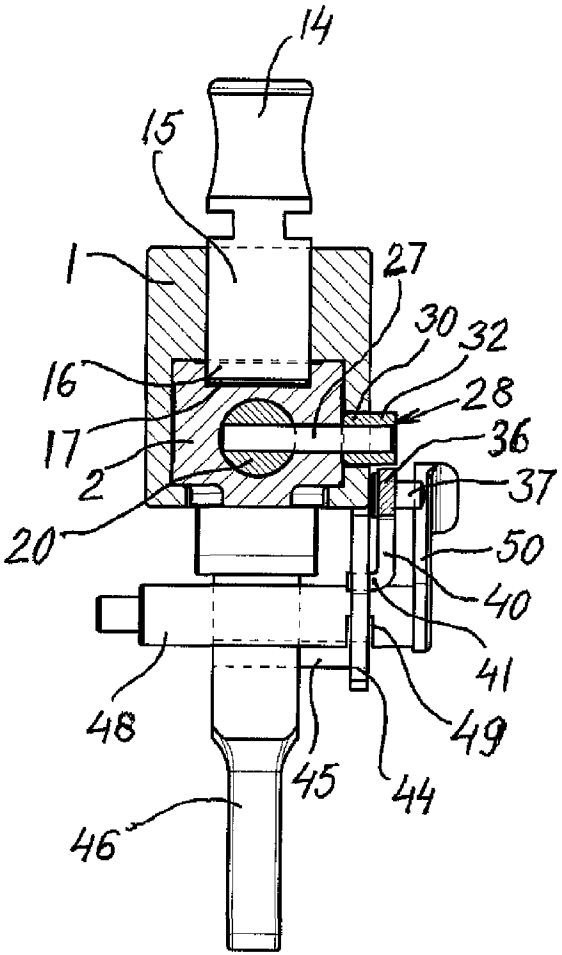
FIG. 10 is a cross section view of the breech device of FIG. 5 taken along the line 10-10.
Figure 13:
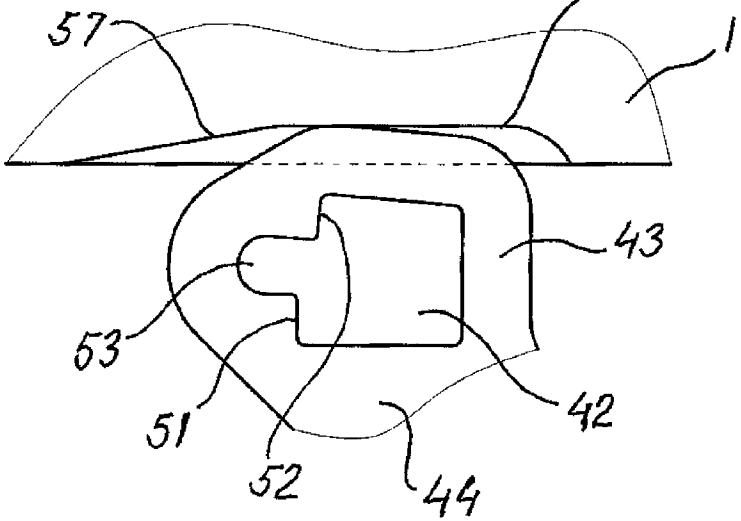
FIG. 13 is an enlarged detailed sectional side view of the trigger link wherein the window portion extends into the longitudinal recess in the side wall of the carrier.
Figure 15:
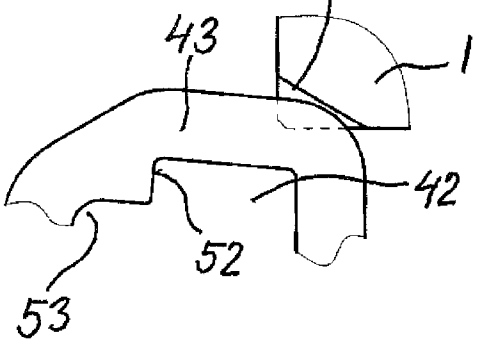
FIG. 15 is a detailed side view of the trigger link extending with its window portion into the bevel at the front area of the carrier.
Figure 14:
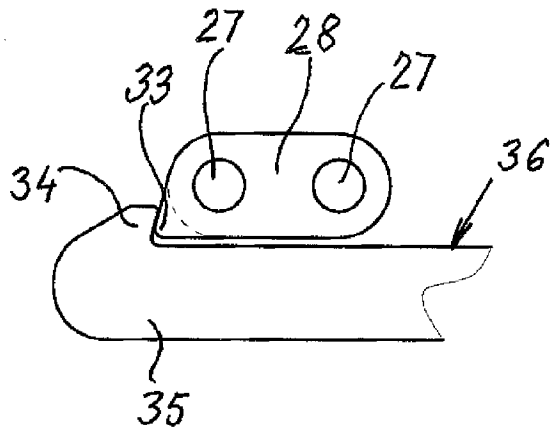
FIG. 14 is an enlarged detailed side view of the tensioning element with the nose being interlocked with the stop detent of the trigger lever.
Figure 22:
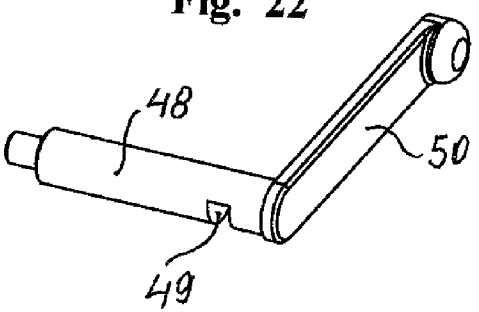
FIG. 22 is a perspective view of the firing mode selector.
Figure 21:
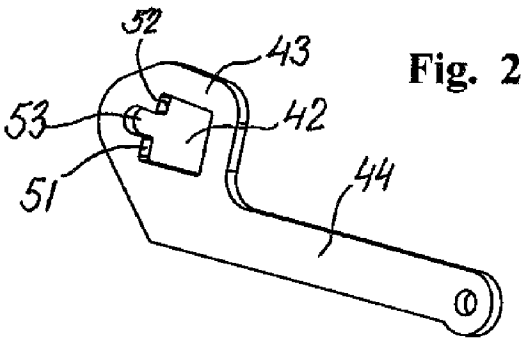
FIG. 21 is a perspective view of the trigger link.
Figure 19:
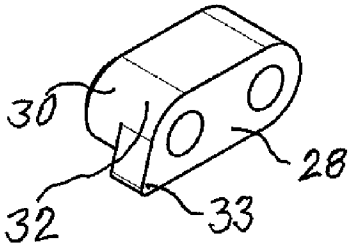
FIG. 19 is a perspective view of the tensioning element.
Figure 20:
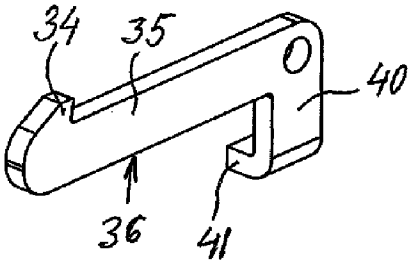
FIG. 20 is a perspective view of the trigger level.
Figure 18:
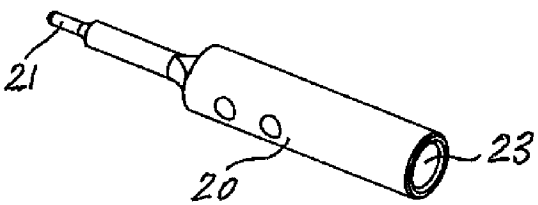
FIG. 18 is a perspective view of the firing pin with the striker.
Figure 16:
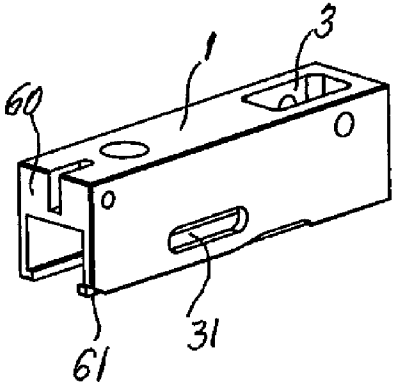
FIG. 16 is a perspective view of the carrier.
Figure 17:
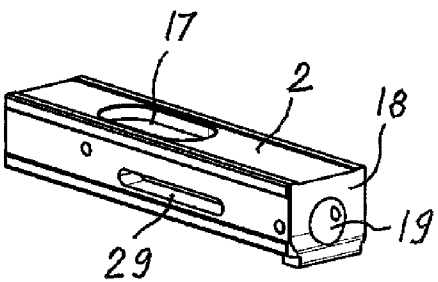
FIG. 17 is a perspective view of the breech block.

As soon as the shooter releases the grip 14, the carrier 1 with the breech block 2 is shifted towards the barrel due to the action of the forwarding spring 11. During the forward motion, the cartridge is inserted into the cartridge chamber and the tensioning element 28 of the firing pin 20, namely the nose 33 of the tensioning element 28, is engaged by the stop detent 34 of the trigger lever 36. As the carrier 1 keeps moving, the firing spring 24 is tensioned and so the firing pin 20 as well as the tensioning pin 15 in the transfer slot 17 acts upon the breech block 2 the cartridge is inserted into the cartridge chamber and simultaneously the locking arm 5 is lowered around its bearing pin 4, so that its free end 6 is set before the cross stop 7 and so the breech device is locked. Preferably, the firing pin 20 is tensioned 13 millimetres before the breech device is locked. During the final forward motion of the carrier 1, the window portion 43 of the trigger link 44 slides down the bevel 61 in the front part 60, down the lower part and down the inclined part 57 on the carrier 1 and gets into the longitudinal recess 56 of the carrier 1. Being in such position the breech device is locked and the firearm is prepared for semi automatic firing, as shown in FIG. 5, wherein the trigger mechanism is positioned for firing single shots. At the same time, the trigger link 44 is seated on the whole bottom surface of the cross slot 49 on the fire mode selector 48 and the bend 41 of the trigger lever 36 is positioned against the lower stop area 51 at the window 42 of the trigger link 44.

By pulling the trigger 46 against the action of the trigger spring 59, the trigger link 44 is shifted and so the bend 41 on the shorter arm 40 of the trigger lever 36 contacts the lower stop area 51 at the window 42 of the trigger link 44. Thereby the trigger lever 36 is swivelled around the supporting pin 37 and consequently the nose 33 of the tensioning element 28 disengages the stop detent 34. The firing pin 20 is thereby released and launched towards the cartridge by means of the firing spring 24 and the striker 21 actuates the primer of the cartridge and so the shot is fired. Subsequently, the breech device is unlocked by the pressure of the fired cartridge, namely by the pressure of the powder gases, the pressure acting on the breech block 2. At the same time the used cartridge is removed and rejected. As the breech block 2 and then its carrier 1 are moved backwards by the end part 16 of the tensioning pin 15, the end part 16 extending into the transfer slot 17 in the breech block 2, the breech device is unlocked. During the motion of the carrier 1, the free end 6 of the locking arm 5 is shifted over the edge of the cross stop 7 so that the locking arm 5 gets out of the engagement with the cross stop 7. During the backward motion of the carrier 1, the window portion 43 of the trigger link 44 is pushed out of the longitudinal recess 56 of the carrier 1 such that the trigger link 44 is swivelled against the action of the pressure spring 54. The swivelling of the trigger link 44 causes the notch 53 at the window 42 to be set opposite the bend 41 of the trigger lever 36 so that any further action of the trigger 46 upon the trigger lever 36 is prevented. The stop detent 34 of the trigger lever 36 is then ready to receive the firing pin 20 during the following forward motion of the breech device, which has performed the whole backwards motion. As the breech device is moved forward by the forwarding spring 11, the next cartridge is inserted into the cartridge chamber and a part of the window portion 43 of the trigger link 44 gets into the longitudinal recess 56 in the carrier 1. This sets the trigger link 44 in a position in which the lower stop area 51 at the window 42 is arranged opposite the bend 41 of the trigger lever 36. Thus the firearm is ready for firing the next shot.

If a fully automatic firing mode is required, the shooter turns the firing mode selector 48 to a position in which the trigger link 44 engages the edge of the sloping bottom of the cross stop 49 of the fire mode selector 48, i.e., being swivelled as far as possible, wherein the upper stop area 52 at the window 42 of the trigger link 44 is set opposite the bend 41 of the trigger arm 36. Then the shooter grasps at the grip 14 of the tensioning pin 15 and pulling it towards himself, he shifts the carrier 1 against the action of the forwarding spring 11 until the breech device is unlocked, wherein the locking arm 5 gets out of the engagement with the cross stop 7. Locking and preparing the firearm for shooting is the same as described above for the semi automatic firing mode. When the trigger 46 is pulled, the upper stop area 52 is set opposite the bend 41 of the trigger lever 46. Therefore the trigger lever 36 is swivelled and so the firing pin 20 with the striker 21 is released to actuate the primer of the first cartridge like in the case of semi-automatic shooting. However, the trigger lever 36 stays in the swivelled position even after the shot. Therefore the firing pin 20 is not tensioned during the next forward motion of the breech device. Instead, the next cartridges are actuated as long as the trigger 46 is pulled or any cartridges are available. This is due to the fact that the firing pin 20 affected by its firing spring 24 continuously follows the movement of the carrier 1. During the locking, the firing pin 24 is about 2 millimetres ahead and actuates the primer of the next cartridge inserted into the cartridge chamber again. The structure of the breech device is such that the next cartridge is actuated always about 2 millimetres before a complete locking of the breech device, so that a so-called pre-ignition is used. The carrier 1 strikes against the breech block 2 by means of the tensioning pin 15 and its forward drive acts against the ignition energy of the primer, so that the unwanted recoil of the firearm is partially suppressed and any bouncing of the carrier 1 is prevented during the firing and afterwards.

The invention claimed is:

1. A breech device of a hand firearm, comprising:

a firearm casing including a cross stop;

a trigger mechanism including a trigger lever pivotally coupled to the firearm casing and having a stop detent;

a carrier slidably arranged within the firearm casing, the carrier including a rear portion having a vertical well, a side wall including a limiting slot therethrough, and a locking arm disposed in the vertical well, the locking arm pivotally coupled to the carrier with a bearing pin and including a free end that engages the cross stop;

a breech block engaging the carrier, the breech block including a transfer slot along a top surface, a side wall having a through slot, and a slidable firing pin with a striker;

a tensioning element including an oval driving part slidably engaged with the limiting slot of the carrier and a projecting part including a forward-directed nose adapted to engage the stop detent of the trigger mechanism;

at least one follower pin coupled to the tensioning element and engaging the firing pin, the at least one follower pin being adapted to slide in the through slot of the breech block; and a tensioning pin slidably engaging the carrier and including an end part extending into the transfer slot of the breech block.

2. The breech device of claim 1, wherein the forward-directed nose of the tensioning element is formed having a negative angle of mating with the stop detent of the trigger mechanism.

3. The breech device of claim 1, wherein the trigger lever includes a short arm having a bend, and the trigger mechanism further comprises:

a trigger; and a trigger link including a first end pivotally connected with the trigger and a second end including a window portion with a window, the window including forward-directed stop areas adapted to engage with the bend and a notch disposed between the stop areas adapted to allow the bend to be engaged with the trigger link.

4. The breech device of claim 2, wherein the trigger lever includes a short arm having a bend, and the trigger mechanism further comprises:

a trigger; and a trigger link including a first end pivotally connected with the trigger and a second end including a window portion with a window, the window including forward-directed stop areas adapted to engage with the bend and a notch disposed between the stop areas adapted to allow the bend to be engaged with the trigger link.

5. The breech device of claim 3, wherein the carrier further comprises a lower side wall having a longitudinal recess, the longitudinal recess adapted to engage the second end of the trigger link as the trigger mechanism moves with respect to the carrier.

6. The breech device of claim 4, wherein the carrier further comprises a lower side wall having a longitudinal recess, the longitudinal recess adapted to engage the second end of the trigger link as the trigger mechanism moves with respect to the carrier.

7. The breech device of claim 1, further comprising:

a firing mode selector mounted on the firearm casing, the firing mode selector including a cross slot adapted to rotate into engagement with a central part of a trigger link.

8. The breech device of claim 7, wherein the firing mode selector can be rotated to switch the hand firearm between a single-shot firing mode, a semi-automatic firing mode, and a fully automatic firing mode.

9. The breech device of claim 2, further comprising:

a firing mode selector mounted on the firearm casing, the firing mode selector including a cross slot adapted to rotate into engagement with a central part of a trigger link.

10. The breech device of claim 9, wherein the firing mode selector can be rotated to switch the hand firearm between a single-shot firing mode, a semi-automatic firing mode, and a fully automatic firing mode.

11. The breech device of claim 3, further comprising:

a firing mode selector mounted on the firearm casing, the firing mode selector including a cross slot adapted to rotate into engagement with a central part of the trigger link.

12. The breech device of claim 11, wherein the firing mode selector can be rotated to switch the hand firearm between a single-shot firing mode, a semi-automatic firing mode, and a fully automatic firing mode.

* * * * *